US010686242B2

(12) United States Patent
Norrell et al.

(10) Patent No.: US 10,686,242 B2
(45) Date of Patent: Jun. 16, 2020

(54) RADIO AND POWER POLE

(71) Applicant: Sabre Industries Inc., Alvarado, TX (US)

(72) Inventors: Lance Norrell, Venus, TX (US); Wesley S. Taylor, Raleigh, NC (US)

(73) Assignee: SABRE INDUSTRIES INC., Alvarado, TX (US)

( * ) Notice: Subject to any disclaimer, the term of this patent is extended or adjusted under 35 U.S.C. 154(b) by 424 days.

(21) Appl. No.: 15/418,563

(22) Filed: Jan. 27, 2017

(65) Prior Publication Data

US 2017/0214113 A1 Jul. 27, 2017

Related U.S. Application Data

(60) Provisional application No. 62/287,533, filed on Jan. 27, 2016.

(51) Int. Cl.
*H01Q 1/12* (2006.01)
*H01Q 1/44* (2006.01)
*H01Q 9/32* (2006.01)

(52) U.S. Cl.
CPC ..... *H01Q 1/1242* (2013.01); *H01Q 1/44* (2013.01); *H01Q 9/32* (2013.01)

(58) Field of Classification Search
CPC ..... H01Q 1/1242; H01Q 9/32; H01Q 1/44
USPC ..... 248/511, 539, 541; 52/296, 301, 831, 52/855
See application file for complete search history.

(56) References Cited

U.S. PATENT DOCUMENTS 7,755,561 B2 7/2010 Slattery
9,253,556 B1 * 2/2016 Pounds ..... G10K 11/16
9,281,556 B2 3/2016 Slattery
2005/0264465 A1 12/2005 Baker
2005/0285011 A1 12/2005 Harwood
2010/0026604 A1 * 2/2010 Caldwell ..... H01Q 1/1242 343/890

(Continued)

FOREIGN PATENT DOCUMENTS

WO 9853522 11/1998

OTHER PUBLICATIONS

Notification of Transmittal of the International Search Report and the Written Opinion of the International Searching Authority—dated May 1, 2017.

*Primary Examiner* — Muhammad Ijaz
(74) *Attorney, Agent, or Firm* — Ryan T. Grace; Advent, LLP

(57) ABSTRACT

A radio and power pole that includes a pipe defining a longitudinal interior cavity for storing modular electronic equipment (e.g., radios) is described. The radio and power pole can also include mounting channels extending longitudinally proximate to an interior surface of the interior cavity of the pipe, a structural spine extending longitudinally through the interior cavity of the pipe, ribs spaced apart from one another proximate to the interior surface throughout the interior cavity of the pipe, doors for accessing the interior cavity of the pipe, and a vent trap. The radio and power pole can be configured as a direct bury radio and power pole (possibly including one or more vaults). A radio and power pole can include a precast pier connected to the pipe and configured to support the pipe when the pier is inserted into the ground. A radio and power pole can include a bench disposed about the pipe.

19 Claims, 23 Drawing Sheets

(56) References Cited

U.S. PATENT DOCUMENTS

| | | | | |
|---|---|---|---|---|
| 2011/0085322 | A1* | 4/2011 | Myer | F21S 8/083<br>362/183 |
| 2012/0256810 | A1* | 10/2012 | Caldwell | H01Q 1/1242<br>343/890 |
| 2015/0045093 | A1* | 2/2015 | Hansen, Sr. | H04M 1/0283<br>455/561 |
| 2017/0214115 | A1* | 7/2017 | Norrell | H01Q 1/1242 |

* cited by examiner

RADIO AND POWER POLE

RELATED APPLICATIONS

The present application claims the benefit under 35 U.S.C. § 119(e) of U.S. Provisional Application Ser. No. 62/287,533, filed Jan. 27, 2016, and titled "RADIO AND POWER POLE," which is herein incorporated by reference in its entirety.

BACKGROUND

An antenna may generally be defined as an electrical device that converts electrical power to radio waves and/or radio waves to electrical power. An antenna can be used with, for example, a radio transmitter and/or a radio receiver.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a radio and power pole that includes a pipe defining a longitudinal interior cavity for storing modular electronic equipment (e.g., radios). The radio and power pole can also include one or more (e.g., two) mounting channels extending longitudinally proximate to an interior surface of the interior cavity of the pipe. The radio and power pole can also include a structural spine extending longitudinally through the interior cavity of the pipe. The radio and power pole may also include ribs spaced apart from one another proximate to the interior surface throughout the interior cavity of the pipe. The radio and power pole can also include one or more doors for accessing the interior cavity of the pipe. The radio and power pole can include a vent trap. Further, the radio and power pole can be configured as a direct bury radio and power pole (possibly including one or more vaults). In some embodiments, a radio and power pole can include a precast pier connected to the pipe and configured to support the pipe when the pier is inserted into the ground. In some embodiments, a radio and power pole can include a bench disposed about the pipe.

DRAWINGS

The Detailed Description is described with reference to the accompanying figures.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

Figure 1:
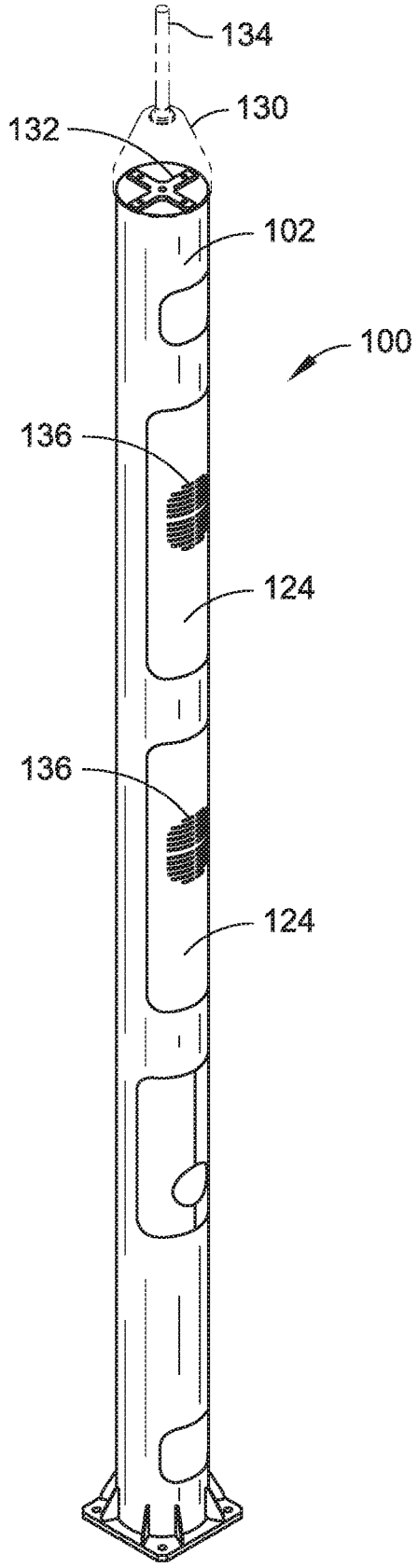
FIG. 1 is an isometric view illustrating a radio and power pole in accordance with an example embodiment of the present disclosure.
Figure 2:
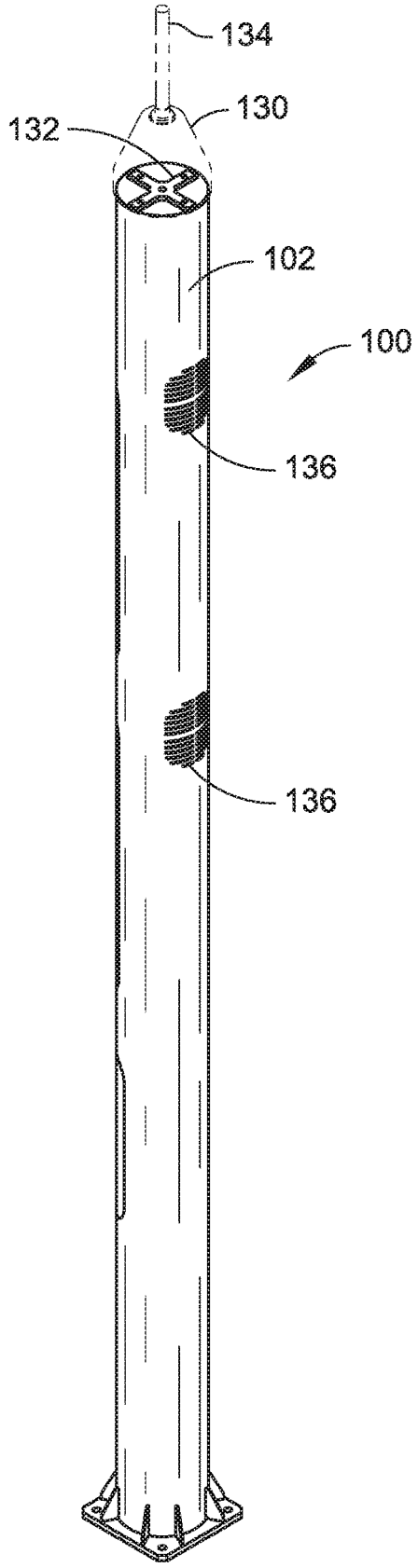
FIG. 2 is another isometric view of the radio and power pole illustrated in FIG. 1.
Figure 3:
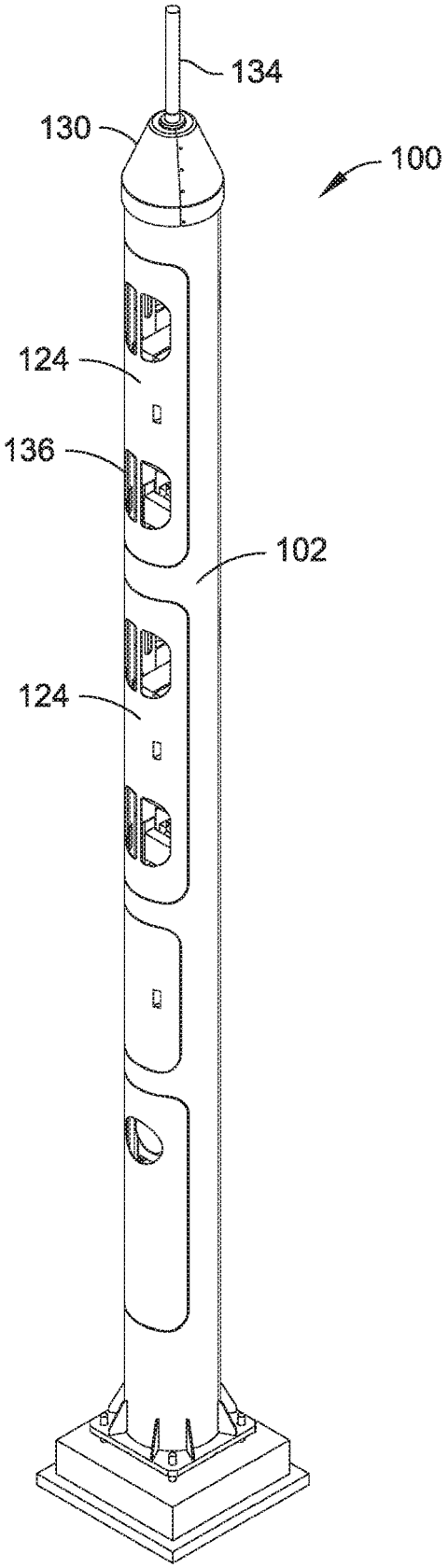
FIG. 3 is a partial isometric view of another radio and power pole in accordance with an example embodiment of the present disclosure.
Figure 4:
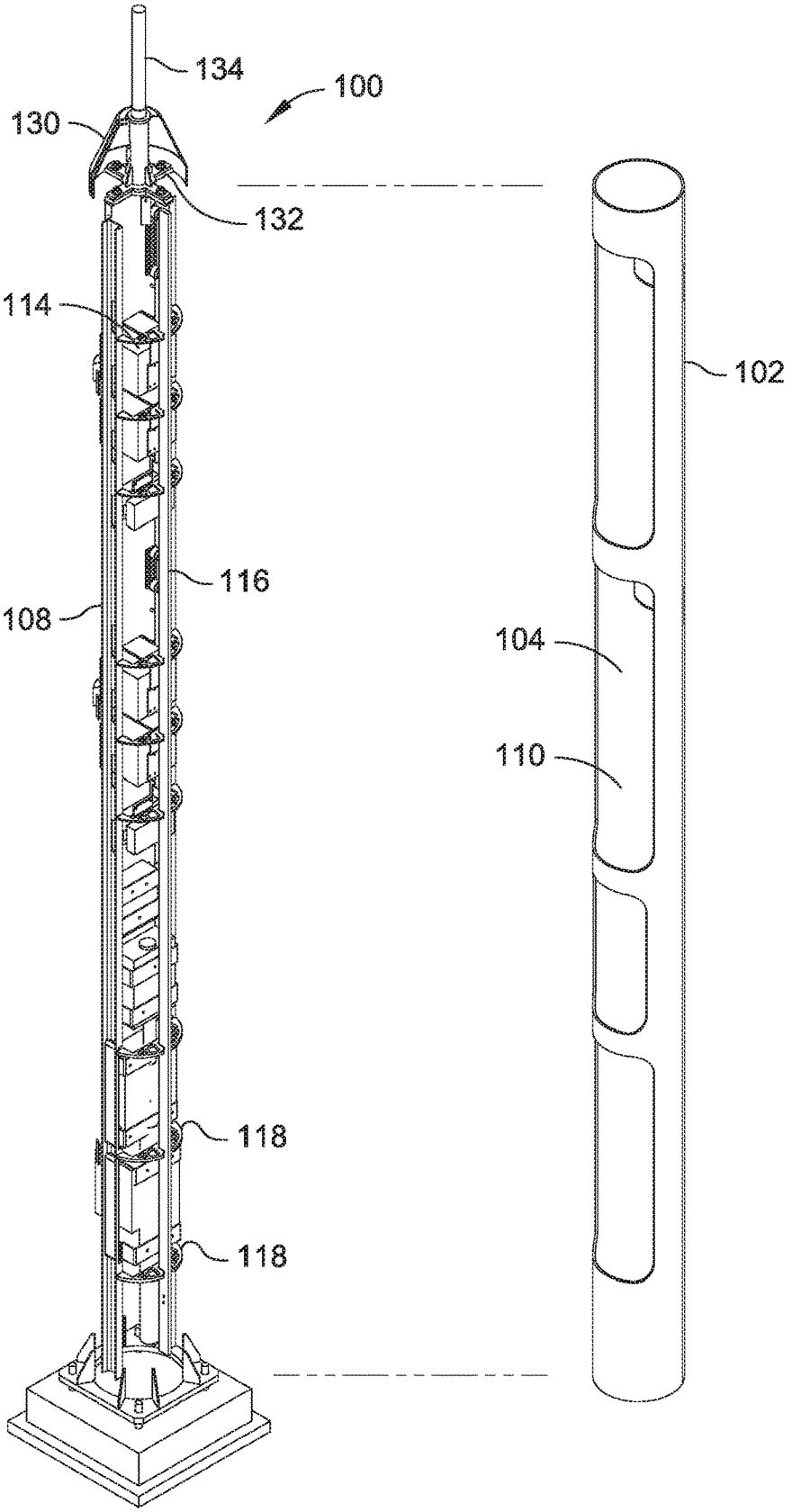
FIG. 4 is an exploded isometric view of the radio and power pole illustrated in FIG. 3.
Figure 5:
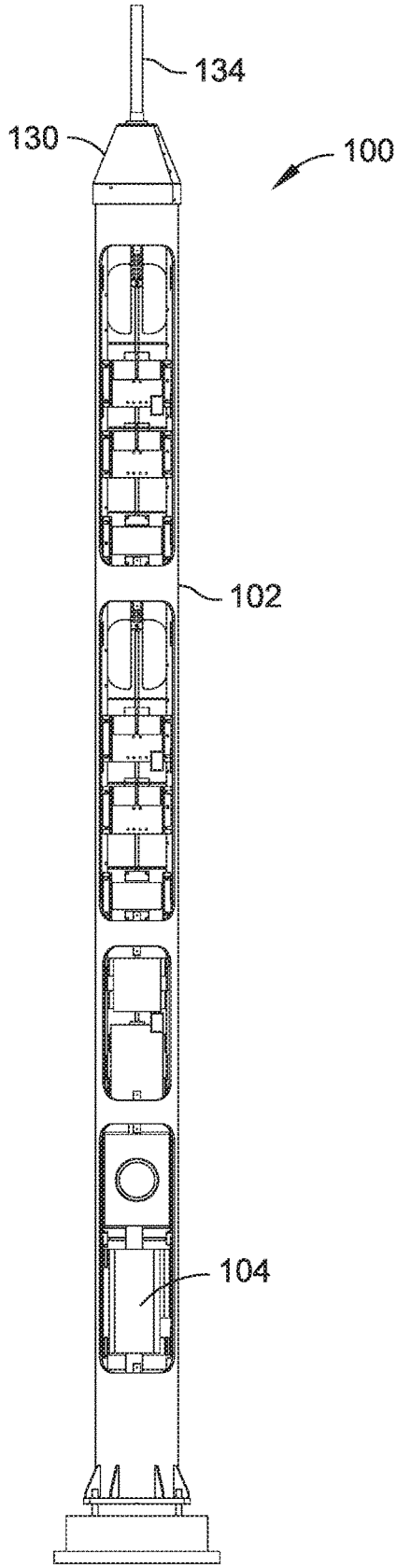
FIG. 5 is a partial side elevation view of the radio and power pole illustrated in FIG. 3.
Figure 6:
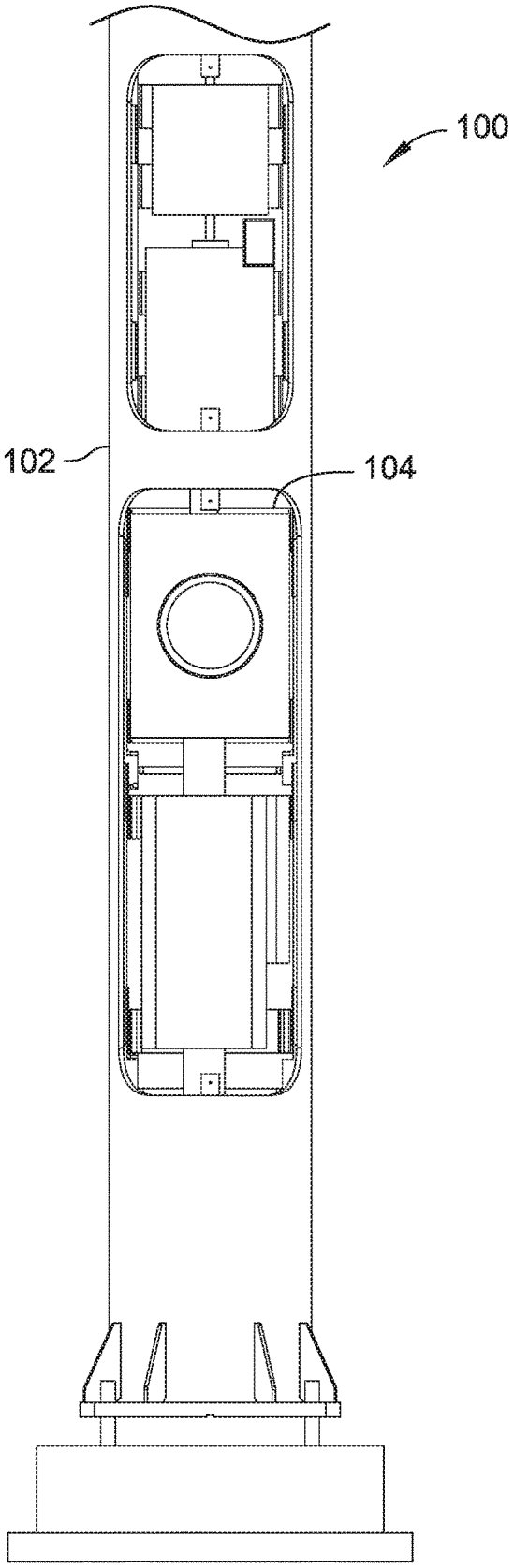
FIG. 6 is another partial side elevation view of the radio and power pole illustrated in FIG. 3.
Figure 7:
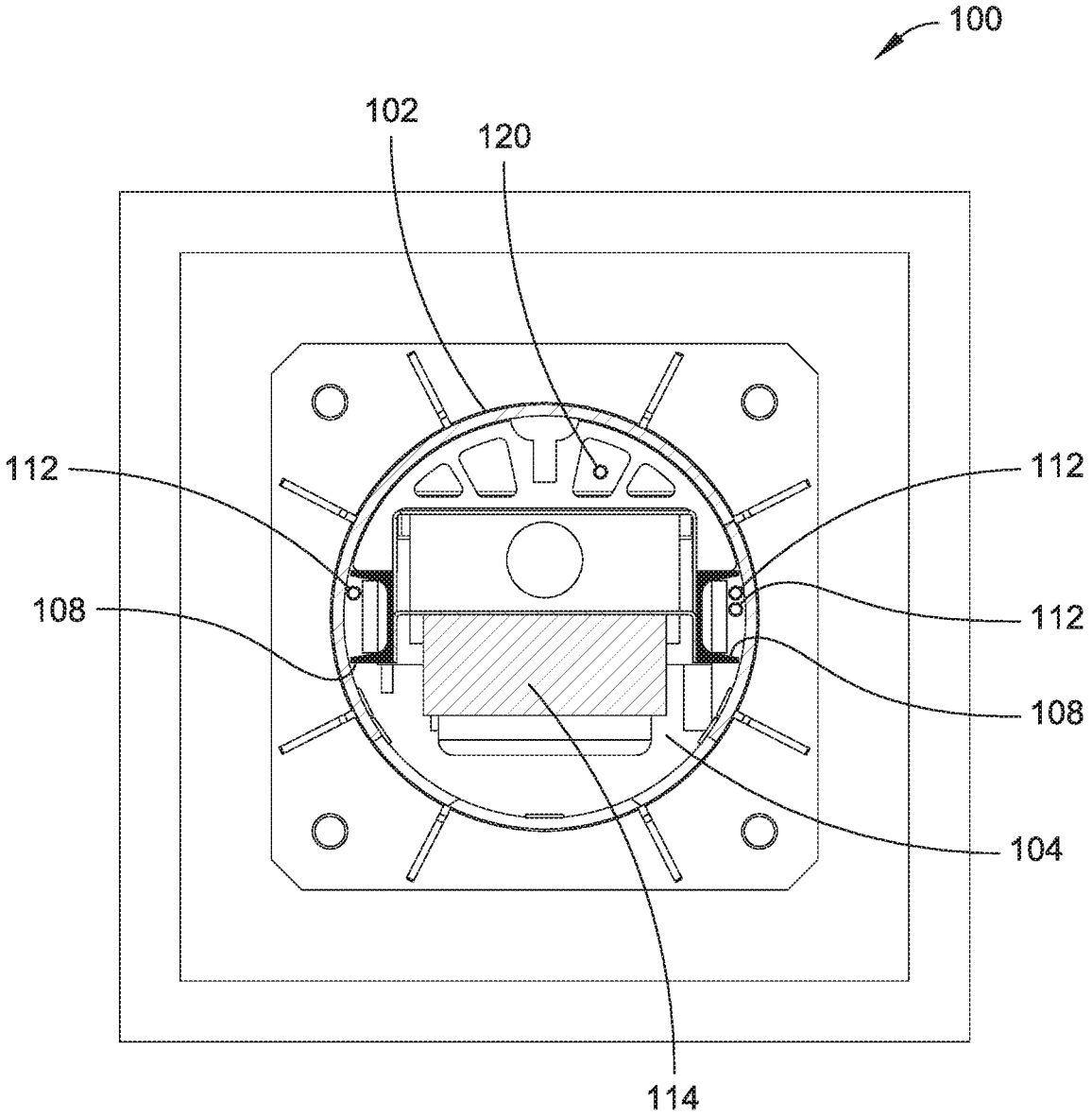
FIG. 7 is a partial top plan view of the radio and power pole illustrated in FIG. 3.
Figure 8:
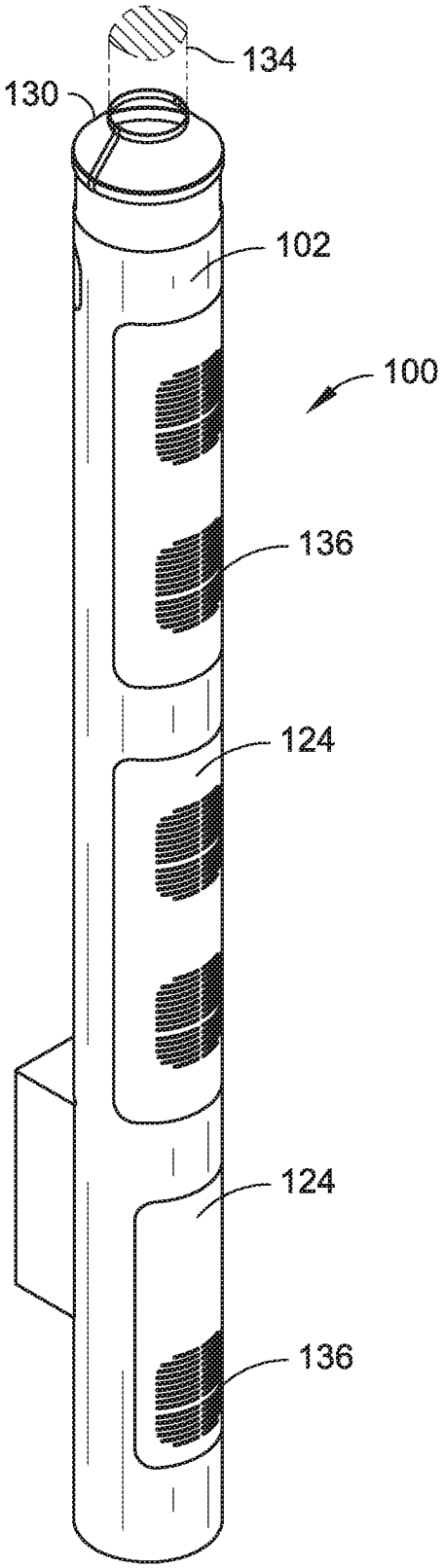
FIG. 8 is an isometric view illustrating a further radio and power pole in accordance with an example embodiment of the present disclosure.
Figure 9:
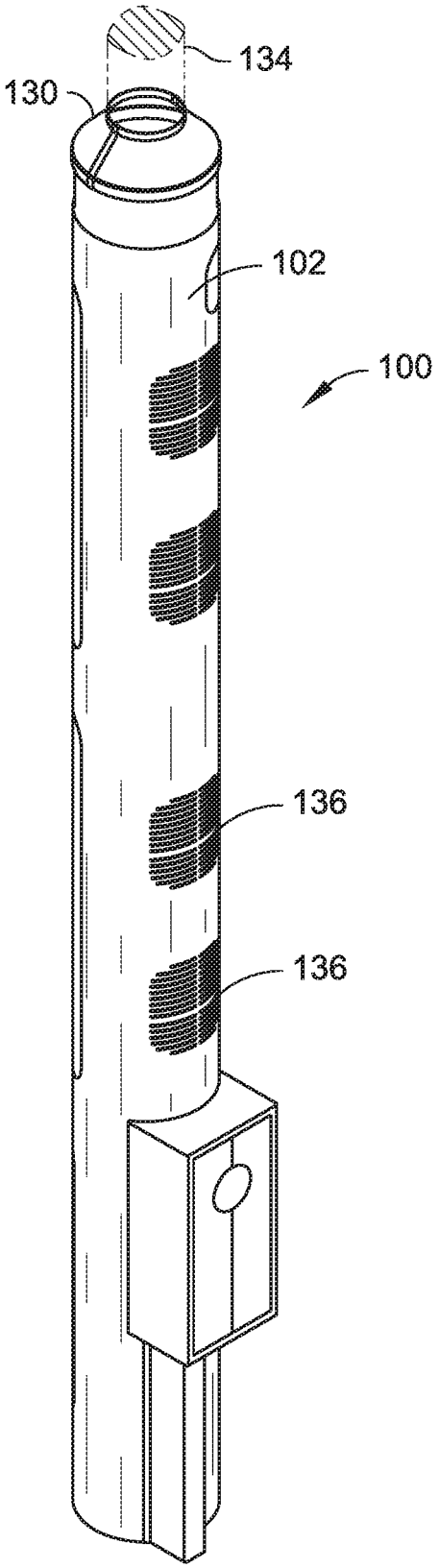
FIG. 9 is another isometric view of the radio and power pole illustrated in FIG. 8.
Figure 10:
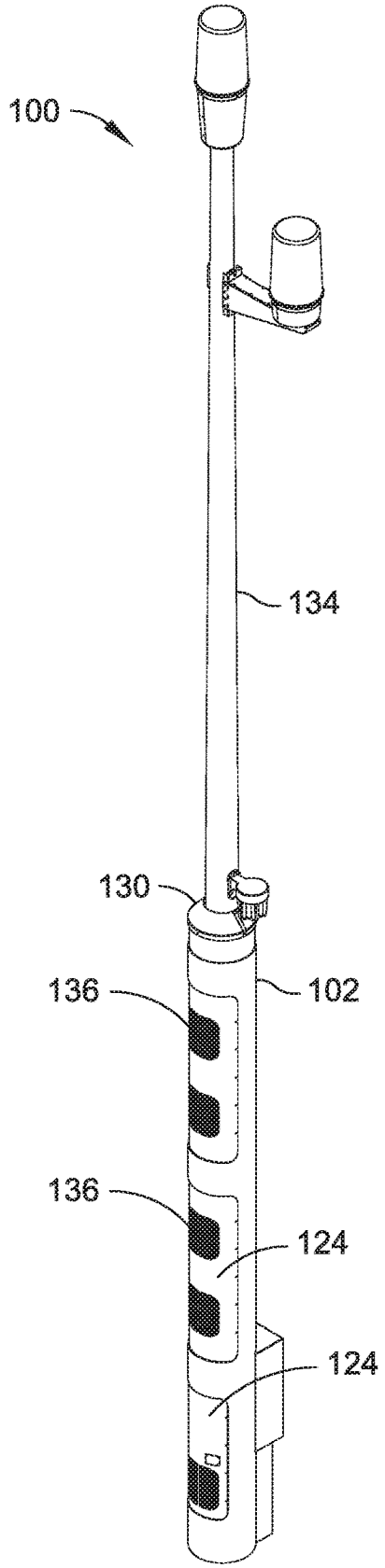
FIG. 10 is a partial isometric view of another radio and power pole in accordance with an example embodiment of the present disclosure.
Figure 11:
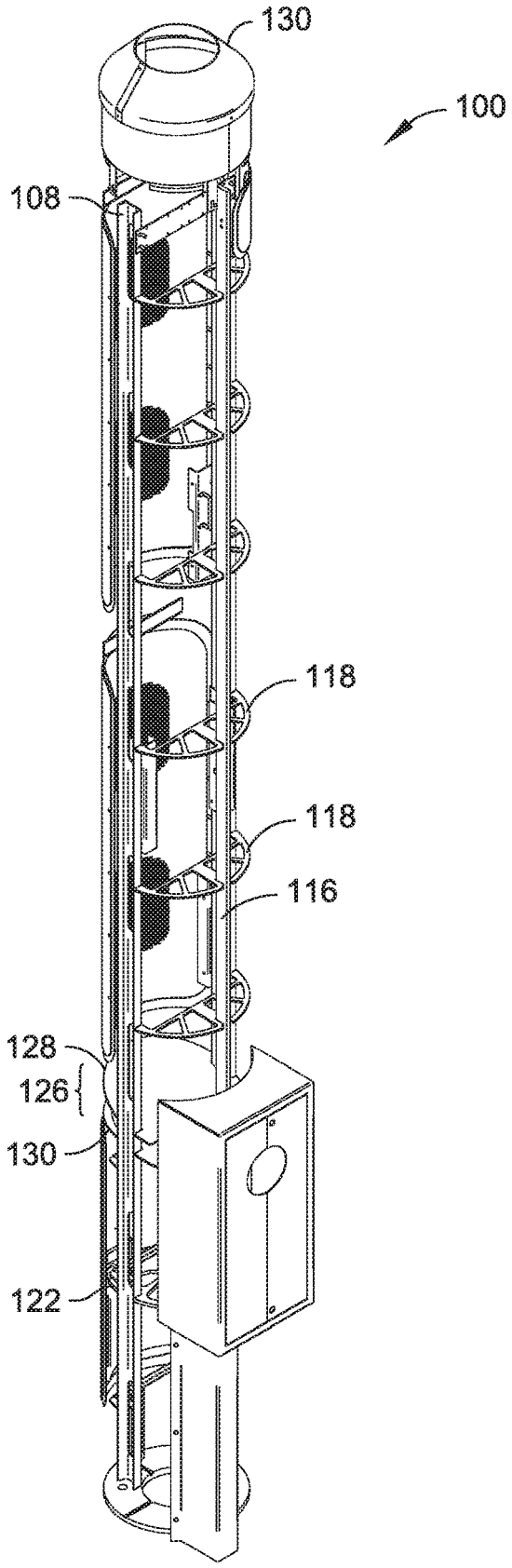
FIG. 11 is a partial isometric view of the radio and power pole illustrated in FIG. 10.
Figure 12:
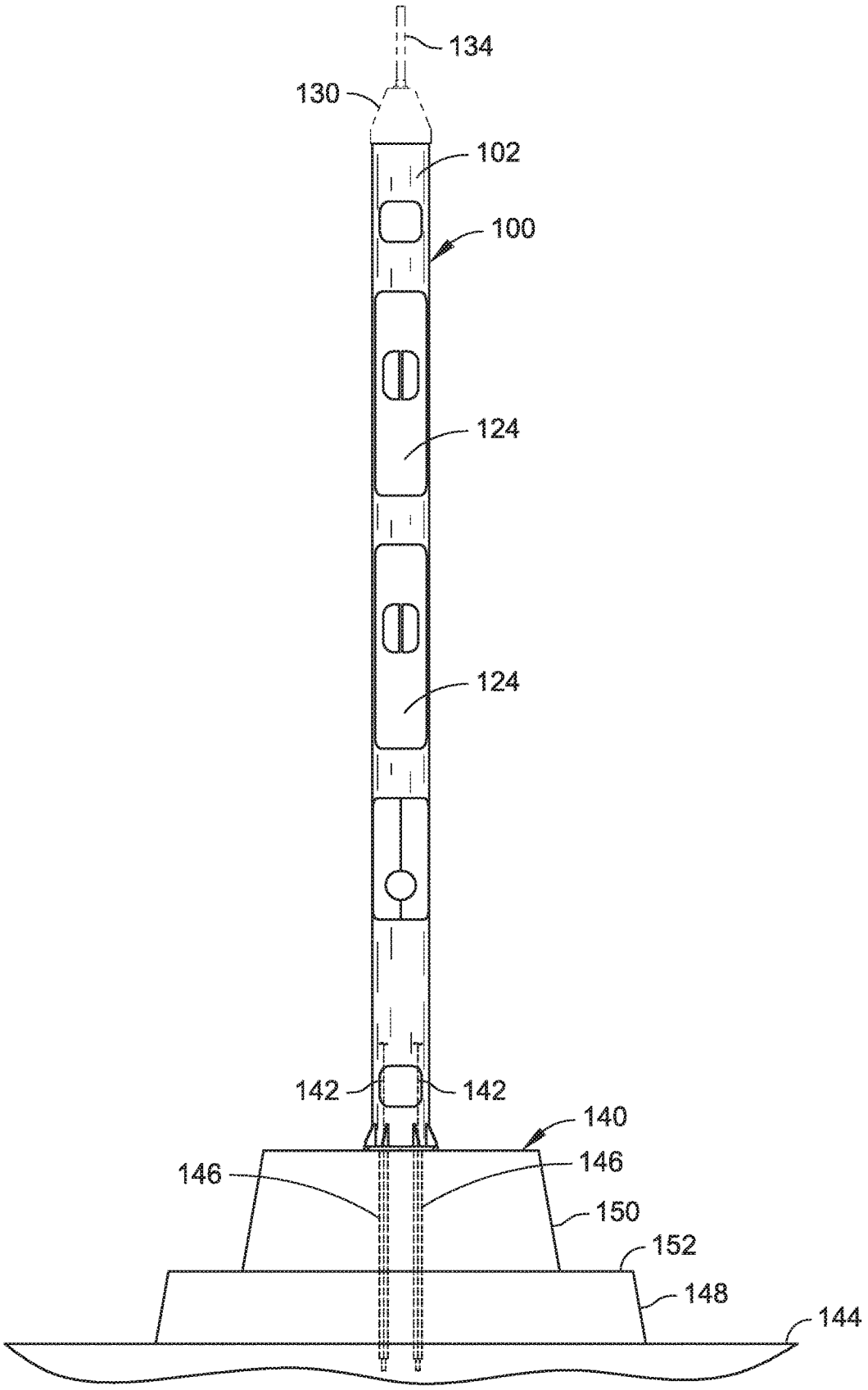
FIG. 12 is a side elevation view illustrating a radio and power pole including bench seating in accordance with an example embodiment of the present disclosure.
Figure 13:
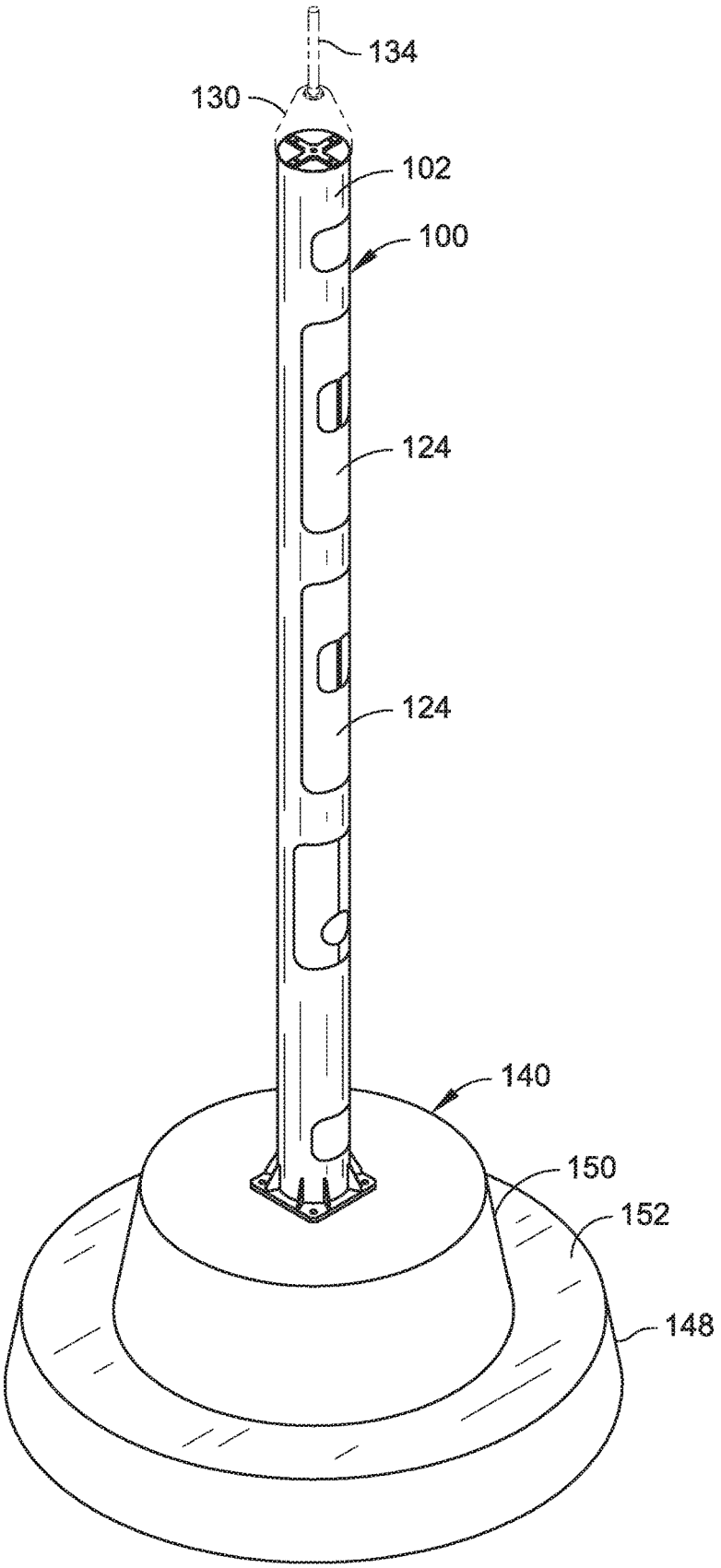
FIG. 13 is an isometric view of the radio and power pole with bench seating illustrated in FIG. 12.
Figure 14:
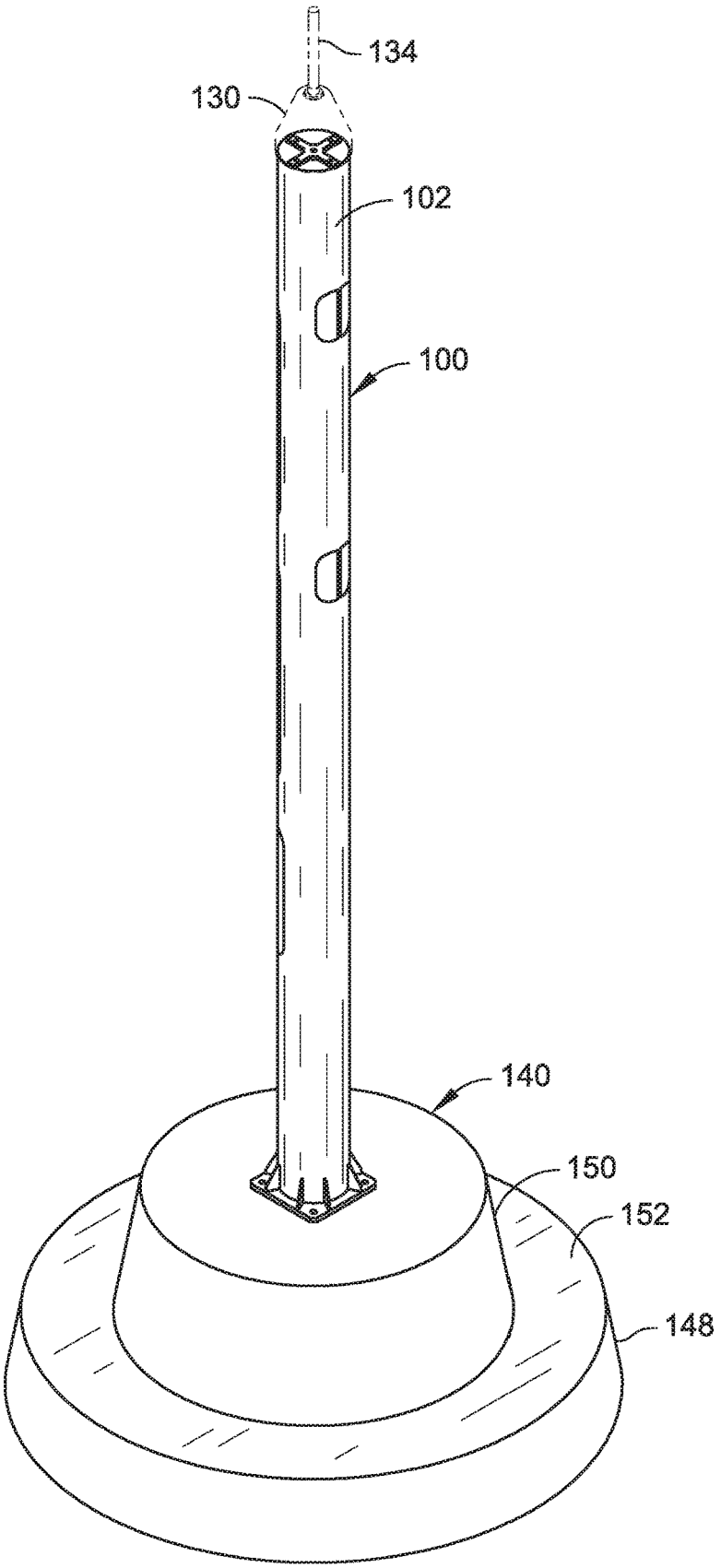
FIG. 14 is another isometric view of the radio and power pole with bench seating illustrated in FIG. 12.
Figure 15:
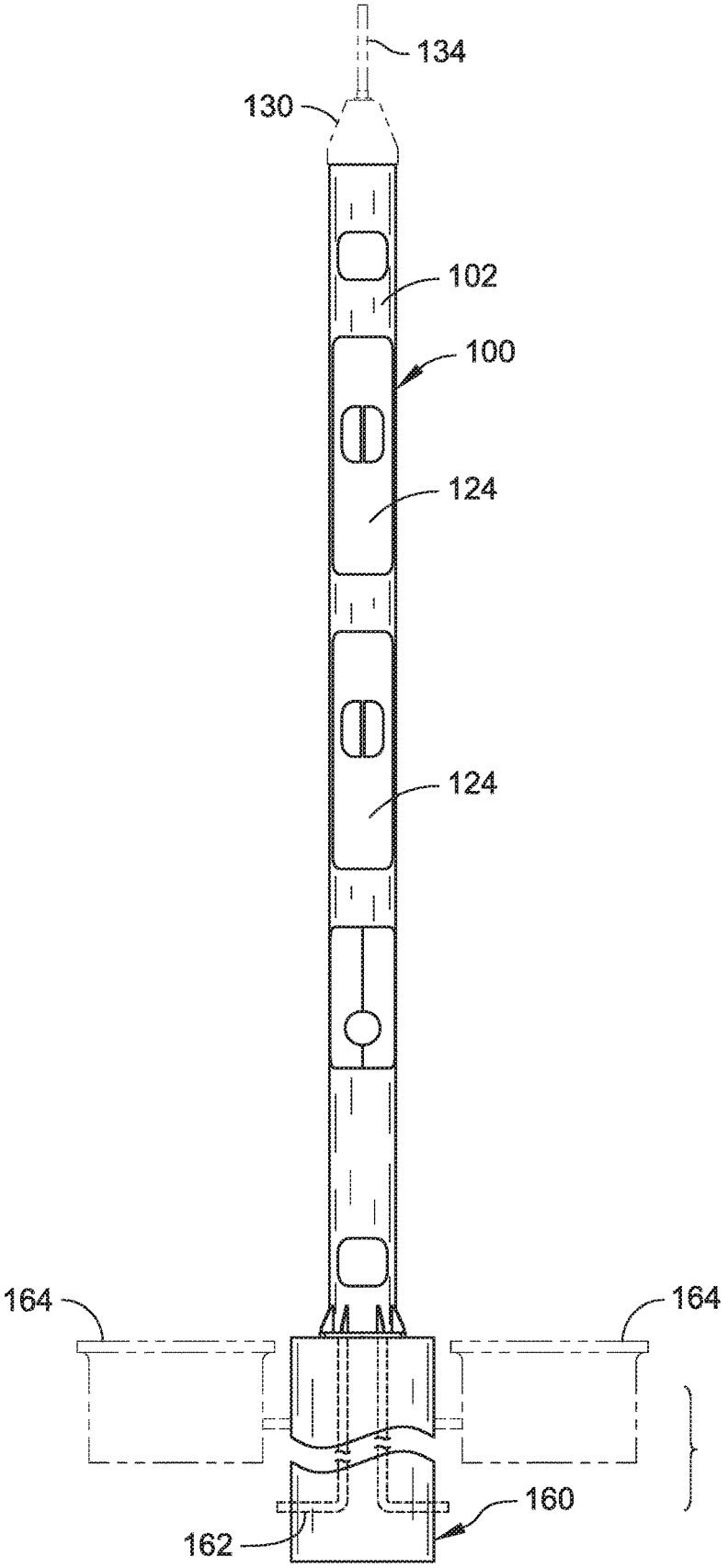
FIG. 15 is a side elevation view illustrating a radio and power pole with a precast pier in accordance with example embodiments of the present disclosure.
Figure 16:
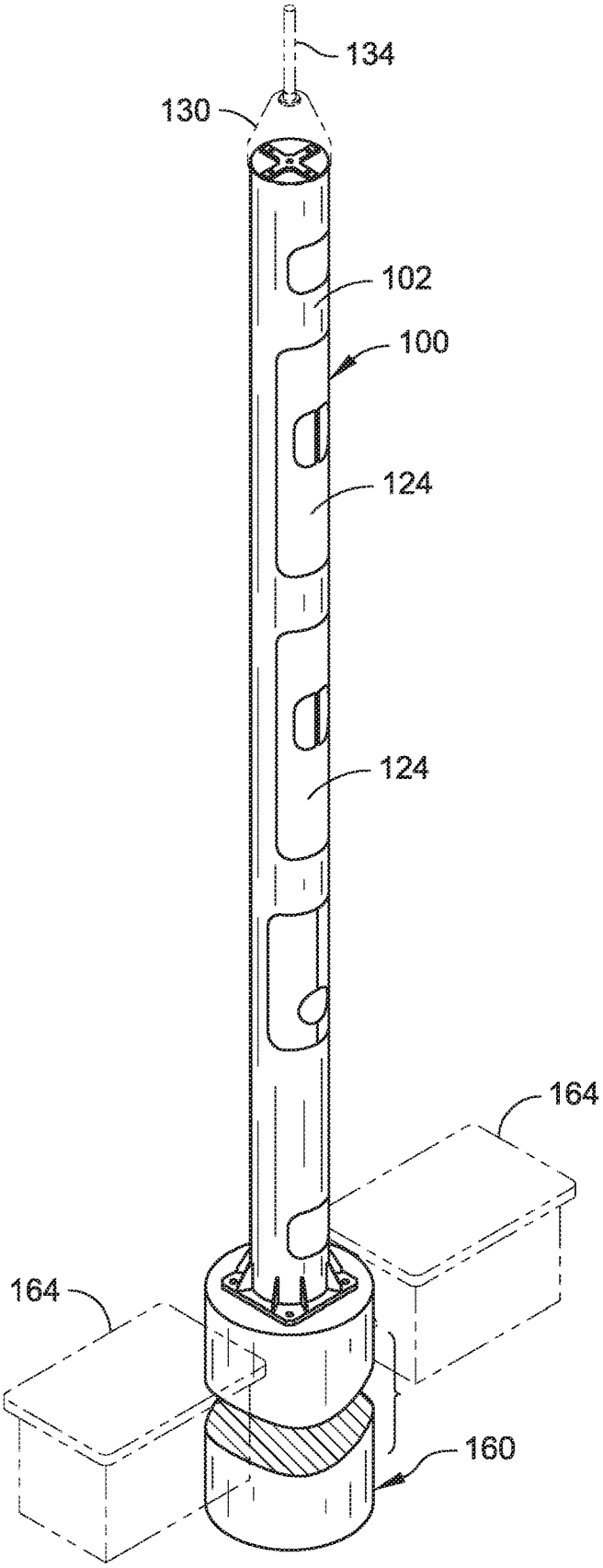
FIG. 16 is an isometric view of the radio and power pole with precast pier illustrated in FIG. 15.
Figure 17:
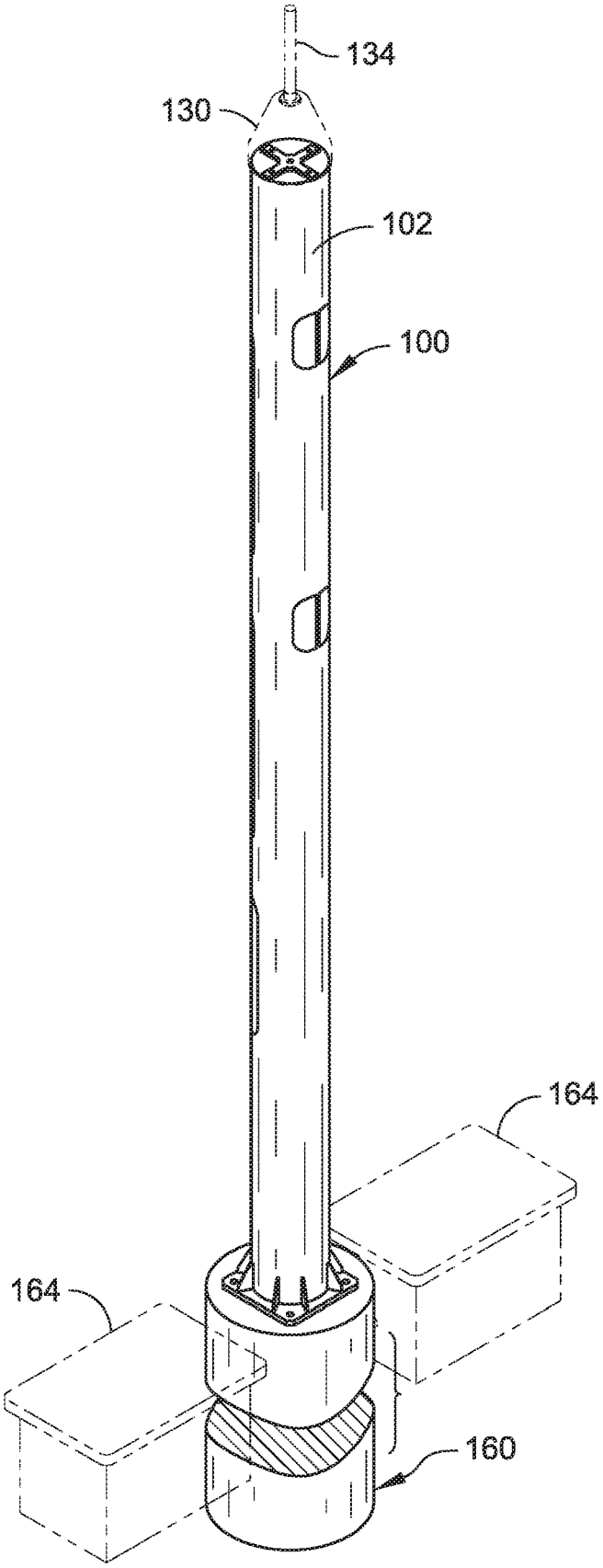
FIG. 17 is another isometric view of the radio and power pole with precast pier illustrated in FIG. 15.
Figure 19:
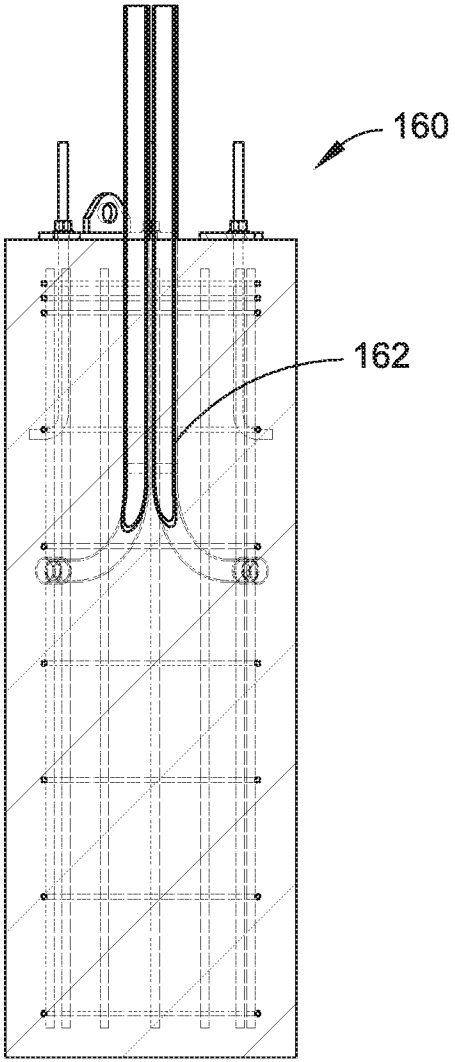
FIG. 19 is a cross-sectional side elevation view of the precast pier illustrated in FIG. 18.
Figure 18:
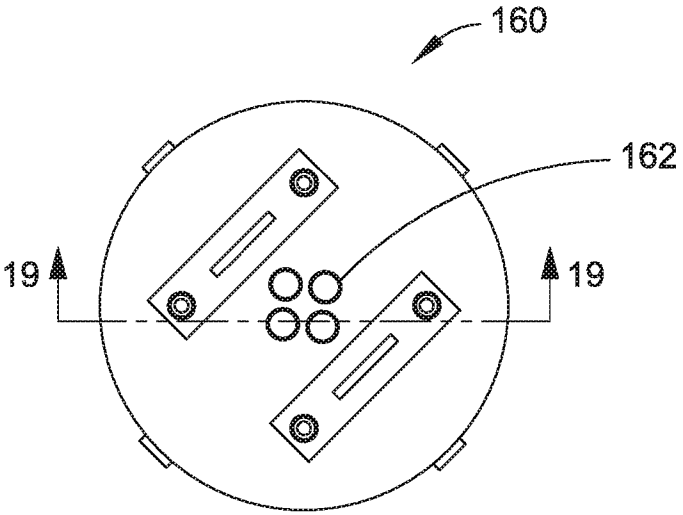
FIG. 18 is a top plan view illustrating a precast pier for a radio and power pole, such as the radio and power poles illustrating in FIGS. 1 through 11, in accordance with an example embodiment of the present disclosure.
Figure 21:
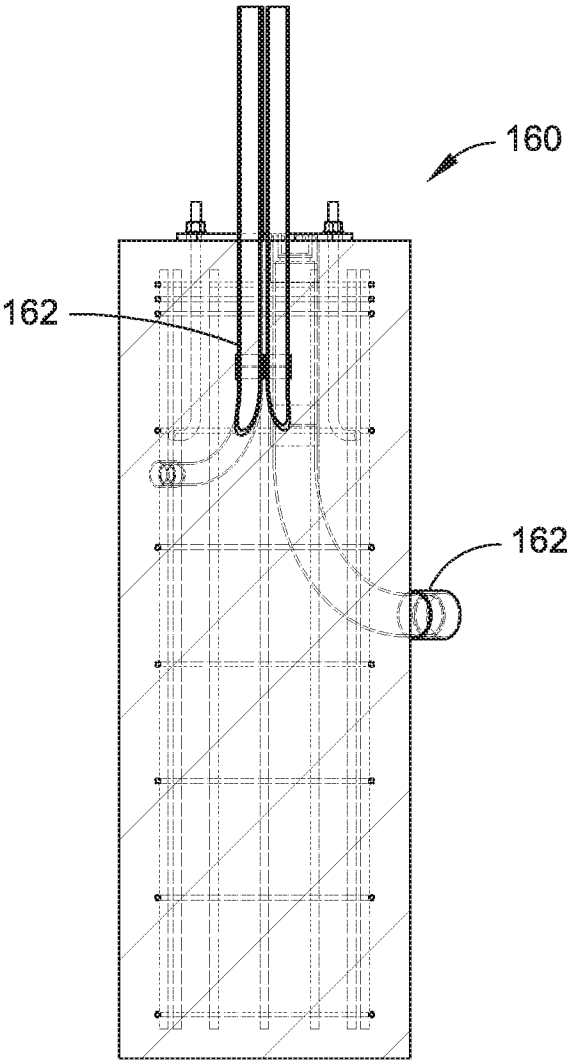
FIG. 21 is a cross-sectional side elevation view of the precast pier illustrated in FIG. 20.
Figure 20:
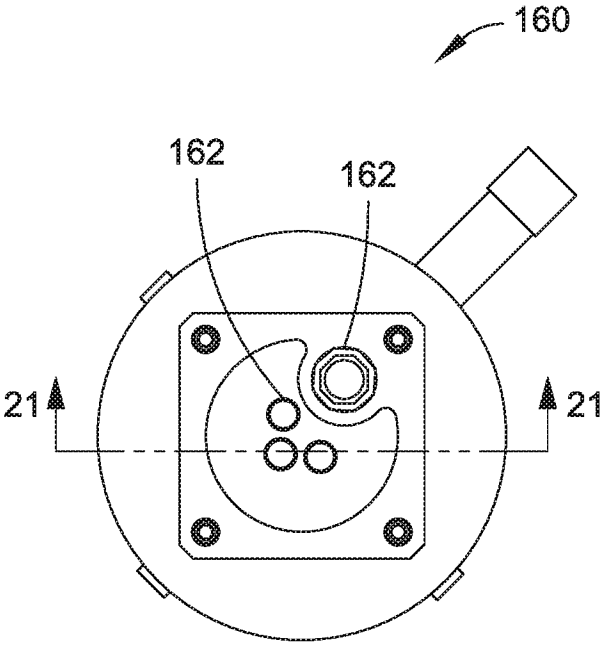
FIG. 20 is a top plan view illustrating a precast pier for a radio and power pole, such as the radio and power poles illustrating in FIGS. 1 through 11, in accordance with an example embodiment of the present disclosure.
Figure 22:
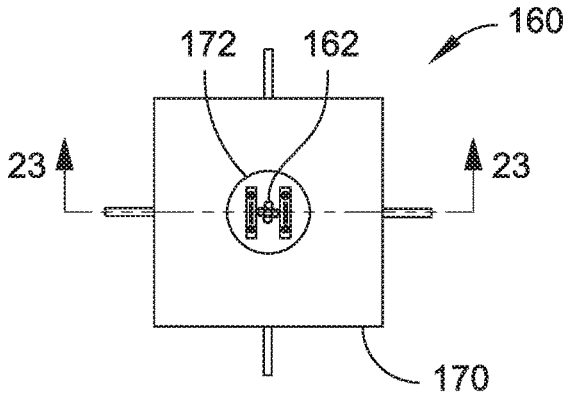
FIG. 22 is a top plan view illustrating a precast pier for a radio and power pole, such as the radio and power poles illustrating in FIGS. 1 through 11, in accordance with an example embodiment of the present disclosure.
Figure 23:
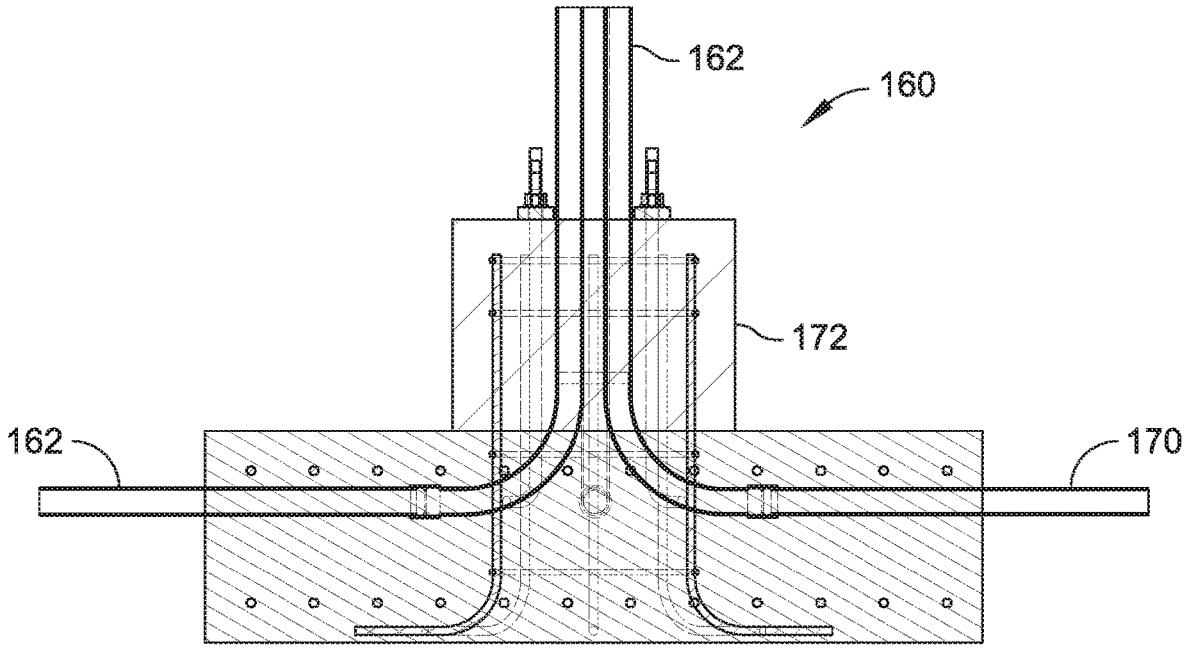
FIG. 23 is a cross-sectional side elevation view of the precast pier illustrated in FIG. 22.
Figure 24:
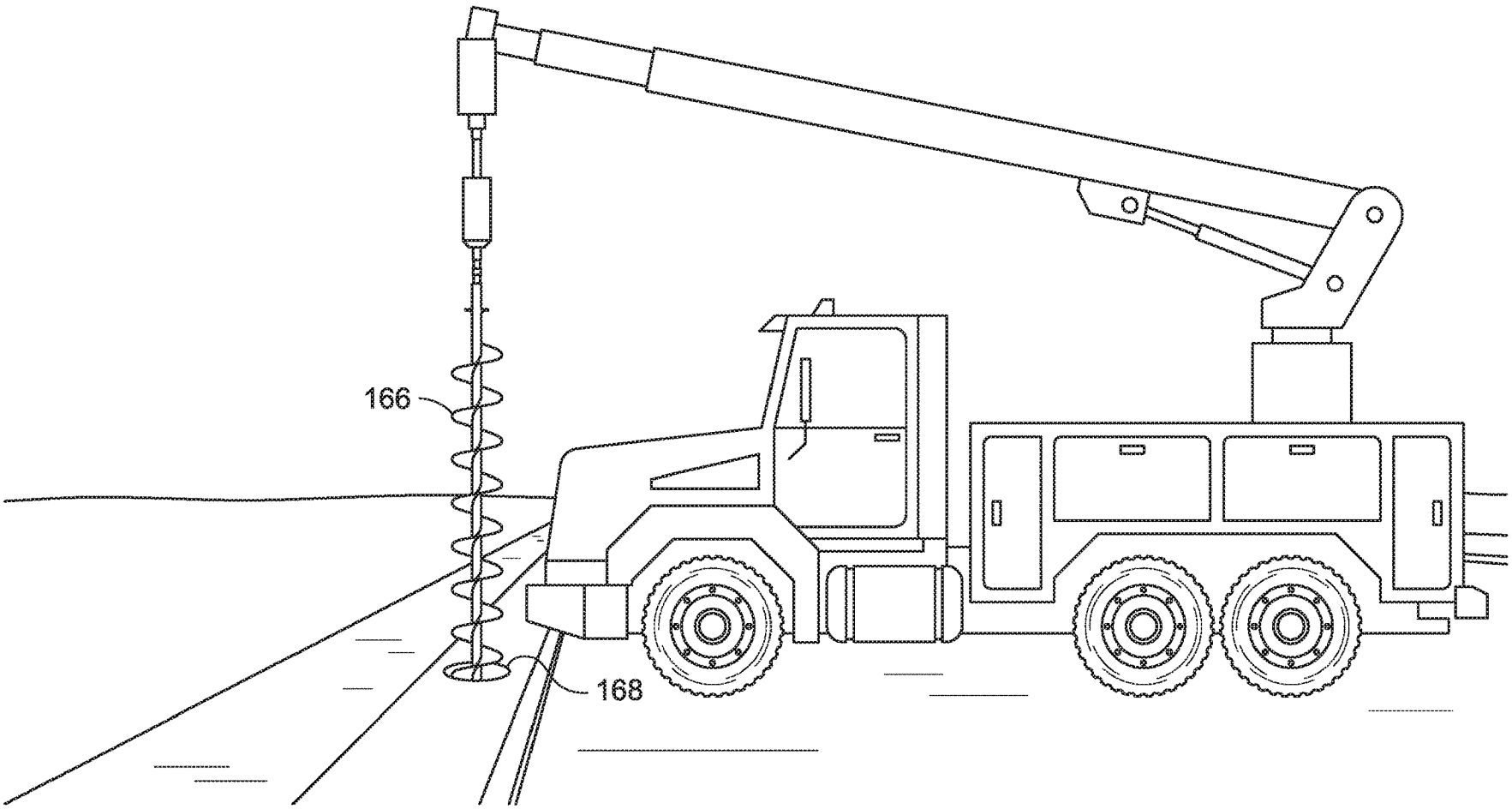
FIG. 24 is a perspective view illustrating an environment for installing a direct bury radio and power pole in accordance with example embodiments of the present disclosure, where an auger is used to form a hole for receiving a direct bury pole.
Figure 25:
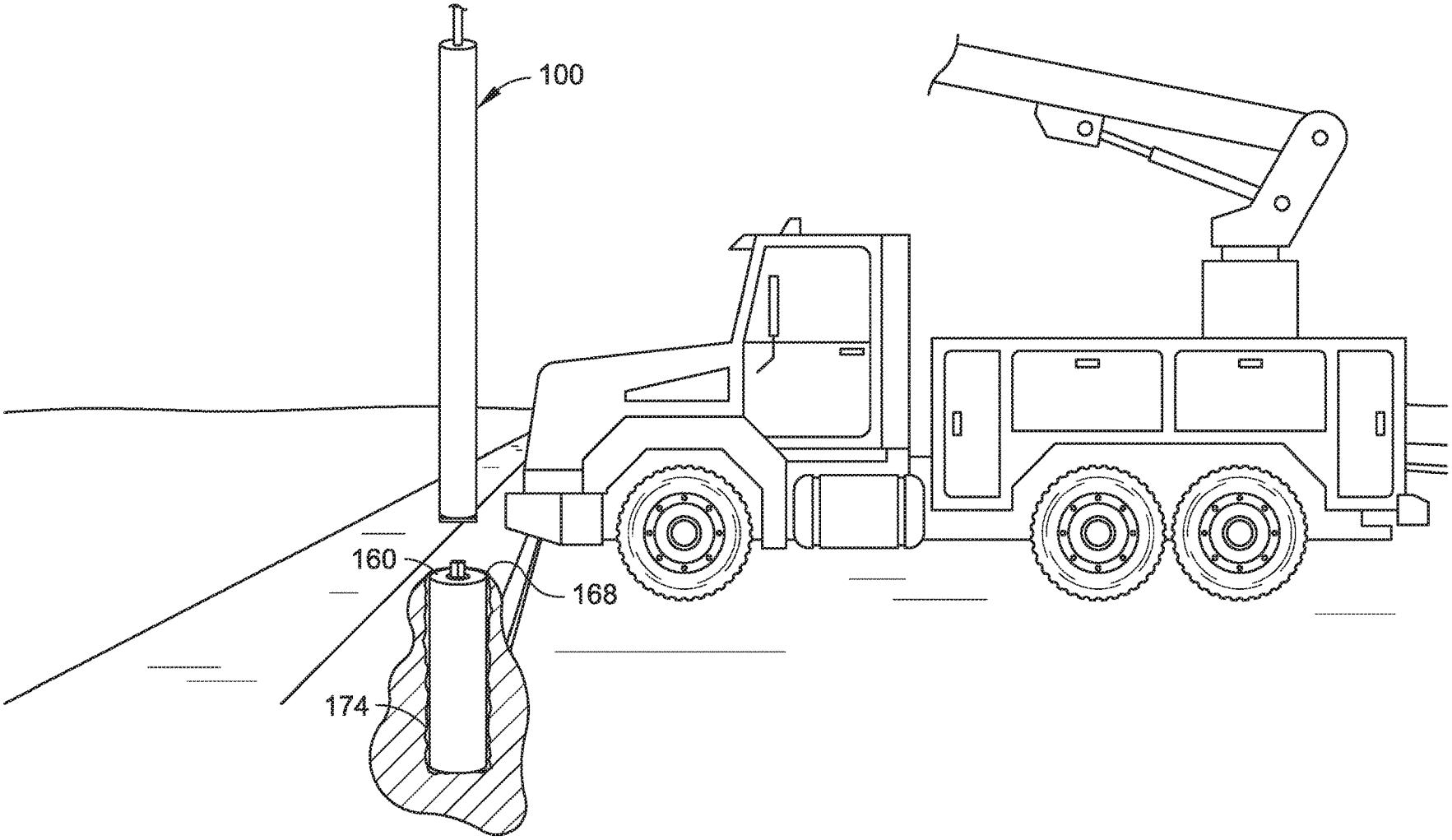
FIG. 25 is another perspective view of the environment illustrated in FIG. 24, where a direct bury radio and power pole is being installed.
Figure 26:
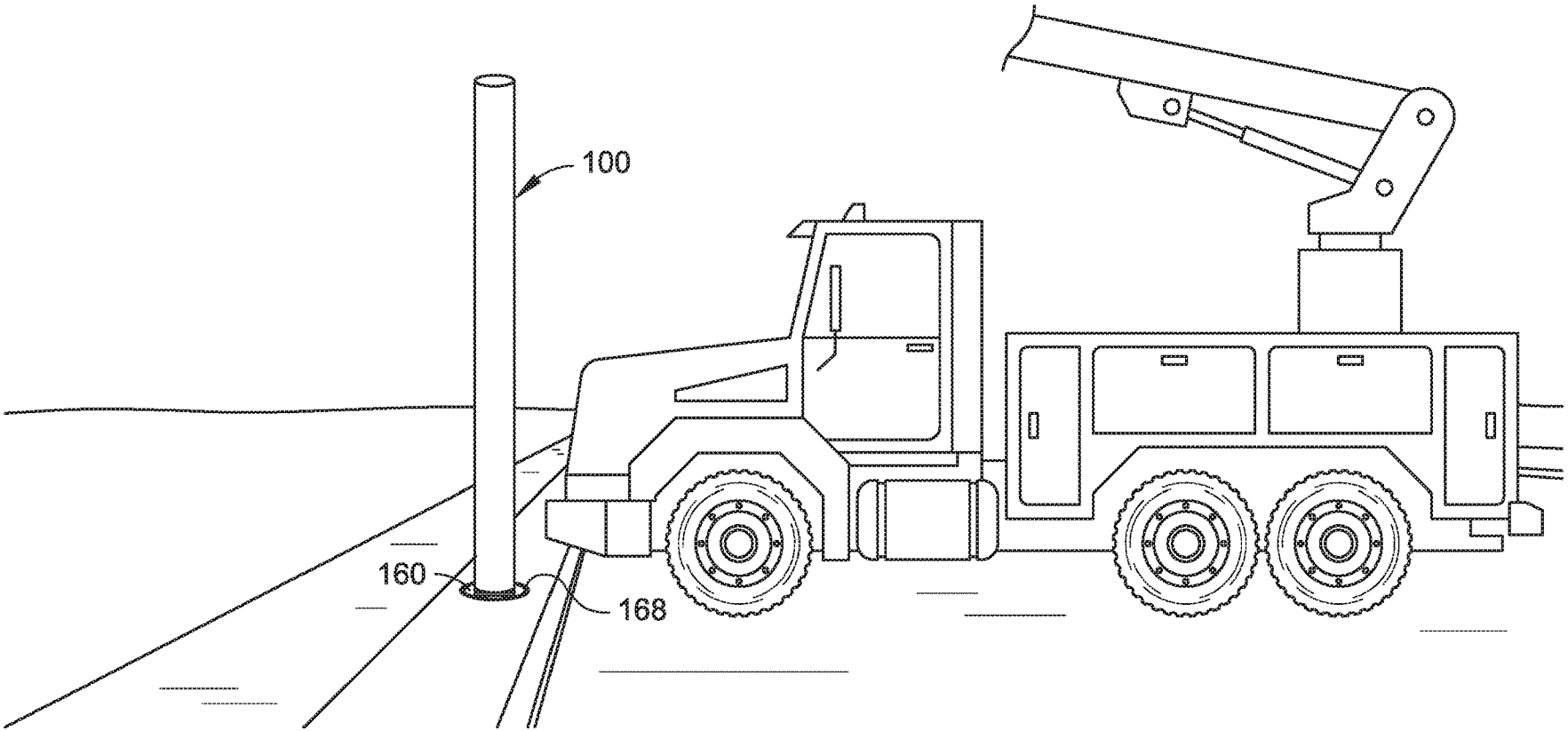
FIG. 26 is another perspective view of the environment illustrated in FIG. 24, where the direct bury radio and power pole has been installed.

Referring generally to FIGS. 1 through 26, radio and power poles 100 are described. The radio and power poles 100 can be used for various applications, including, but not necessarily limited to: small cellular applications (e.g., as low-powered radio access nodes), distributed antenna system (DAS) applications, power applications, communications applications, radio frequency (RF) applications, and so forth. In some embodiments, a radio and power pole 100 includes a pipe 102 that defines a longitudinal interior cavity 104 for storing modular electronic equipment 106 (e.g., radios, diplexers, etc.). The radio and power pole 100 can also include one or more (e.g., two, three, etc.) mounting channels 108 extending longitudinally proximate to an interior surface 110 of the interior cavity 104 of the pipe 102.

In some embodiments, the mounting channels 108 can be configured as generally C-shaped structural channels that extend along each side of the radio and power pole 100. As described herein, a mounting channel 108 can provide structural stability to the radio and power pole 100 (e.g., to meet code requirements). Further, a mounting channel 108 can be configured as a conduit (e.g., a conduit run) for receiving electrical wiring 112. A mounting channel 108 can also be configured to support radio equipment 114 (e.g., as a universal mounting structure for mounting one or more radios within a pole). For example, in some embodiments, one or more mounting channels 108 can include studs for universal mounting (e.g., for use with different bracket configurations and so forth). One or more mounting channels 108 can also include features such as notches for mounting hardware.

The radio and power pole 100 can also include a structural spine 116 extending longitudinally through the interior cavity 104 of the pipe 102 (e.g., proximate to the interior surface 110 of the interior cavity 104 of the pipe 102). As described herein, a structural spine 116 may extend along a back of the pipe 102 and can be used to provide structural support for the pipe 102, to straighten the pipe 102, and/or to hold the pipe 102 in position (e.g., during a welding operation). The radio and power pole 100 may also include ribs 118 spaced apart from one another proximate to the interior surface 110 throughout the interior cavity 104 of the pipe 102. In embodiments of the disclosure, the mounting channels 108, structural spine 116, and/or ribs 118 can be connected together by welding and/or using fasteners (e.g., bolts, screws, etc.).

One or more of the ribs 118 can be configured to hold an antenna 120 (e.g., coaxial cabling for an antenna). For instance, a rib 118 can be skeletonized, defining one or more apertures for receiving electrical wiring, antennas, conduit, and so forth. The ribs 118 can also be configured to mount one or more racking brackets 122 (e.g., for racking radio equipment). In some embodiments, the radio and power pole 100 can also include one or more doors 124 for accessing the interior cavity 104 of the pipe 102. The ribs 118 may also be used to maintain the door opening of a door 124 at a desired radius. In some embodiments, a radio and power pole 100 can include a vent trap 126. The vent trap 126 can be used to minimize or prevent water intrusion into the pipe 102 while still allowing air to flow through the pipe 102. For example, a vent trap 126 can include one or more deflectors, such as a first deflector 128 and a second deflector 130, where the first deflector 128 can direct water in a direction that allows the water to vent downwardly through a passthrough hole while avoiding, for instance, sensitive equipment.

In embodiments of the disclosure, a radio and power pole 100 as described herein allows for cross-ventilation that creates drafting airflow (e.g., from proximate to the bottom of the pipe 102 to proximate to the top of the pipe 102 in the manner of a stovepipe). For example, the radio and power pole 100 can include multiple vents 136, which can be arranged from proximate to the bottom of the pipe 102 to proximate to the top of the pipe 102 to facilitate airflow through the pipe 102. This configuration may reduce or eliminate the need for active cooling hardware within the pipe 102. As described herein, monopole radio and power pole 100 can provide highly configurable mounting options for multiple remote radio heads and/or small cells, along with partial or full concealment of radio equipment (e.g., depending upon desired cooling for the equipment). In some embodiments, battery strings and/or gel cells can be included (e.g., in one or more separated and/or ventilated battery units). Further, a rectifier section can be rated for hardened equipment.

A radio and power pole 100 can include a combiner shelf in a radio unit section (e.g., with a configurable mounting interface). Further, in some embodiments, door and/or fan alarms can be provided (e.g., for remote monitoring). In some embodiments, multiple antenna interfaces can provide for various RF configurations. A radio and power pole 100 can have various diameters, including, but not necessarily limited to: a fourteen inch (14") straight line diameter, a twenty inch (20") straight line diameter, and so forth. Further, various heights can be provided, including, but not necessarily limited to: a twenty foot (20') height, a twenty-four foot, three inch (24' 3") height, a forty foot (40') height, and so forth. In some embodiments, a power bay and multiple (e.g., two) radio bays can be provided. A pole top-to-antenna transition region (e.g., a shroud 130) may also be included (e.g., to mask an antenna mount 132 for an antenna 134 and provide an aesthetically pleasing finish).

In some embodiments, one or more surfaces of a radio and power pole 100 can include a protective finish, including, but not limited to: a galvanized finish, a powder coated finish, and so on. Further, a radio and power pole 100 may be finished in various colors. In some embodiments, the base of a radio and power pole 100 can be about eighteen inches (18") by eighteen inches (18") (e.g., with a twenty inch (20") diameter bolt pattern). Further, an exposed meter base can allow for inspection (e.g., at a sixty-five inch (65") height). However, it should be noted that these measurements are provided by way of example and are not meant to limit the present disclosure. Other radio and power poles 100 can be configured differently.

In some embodiments, a radio and power pole 100 can include a pipe 102 defining a longitudinal interior cavity 104 for storing modular electronic equipment 106 (e.g., as previously described) and a cast support bench 140 disposed about the pipe 102. In this manner, a radio and power pole with seating can be provided. In embodiments of the disclosure, the bench 140 can be cast in a material such as concrete and may include structural supporting material cast within the concrete, such as rebar and so forth. Wiring 142 extends into the pipe 102 for connecting to the modular electronic equipment 106. In embodiments of the disclosure, the bench 140 is configured to support the pipe 102 above a support surface (e.g., the ground 144), and the wiring 142 can be routed through the bench 140 into the pipe 102. For example, the bench 140 can include conduit 146 extending through the bench for routing the wiring 142 through the bench to the interior cavity 104 of the pipe 102.

As described herein, the bench 140 includes a laterally extending base structure 148 immediately proximal to the ground 144, a vertically extending intermediate structure 150 distal to the ground 144, and a transition surface 152 that defines laterally extending seating between the base structure 148 and the intermediate structure 150. For example, the base structure 148 has a generally circular first horizontal cross-sectional area and the intermediate structure 150 has a generally circular second horizontal cross-sectional area less than the first horizontal cross-sectional area. In embodiments of the disclosure, the generally circular first horizontal cross-sectional area and the generally circular second horizontal cross-sectional area can be generally centered about the pipe 102 so that a horizontal annular (e.g., ring-shaped) seating surface having a width of about eighteen inches (18") is provided around the bench 140 (e.g., about eighteen inches (18") from the ground 144).

In some embodiments, the base structure 148 and/or the intermediate structure 150 may slope outwardly toward the ground 144 (e.g., at angles of about ten degrees (10°)). However, it should be noted that these measurements are provided by way of example and are not meant to limit the present disclosure. Other radio and power poles 100 can be configured with different seating arrangements. Further, the base structure 148, the intermediate structure 150, and/or the transition surface 152 seating may employ other shapes, including, but not necessarily limited to: an elliptical shape, a square shape, a rectangular shape, an irregular shape, an asymmetrical shape, and so forth. Further, the intermediate structure 150 can be configured to mount the pipe 102 in a variety of ways. For example, the intermediate structure 150 can be configured to mount a radio and power pole with, for instance, a twenty inch (20") diameter bolt pattern.

In some embodiments, a radio and power pole 100 can include a pipe 102 defining a longitudinal interior cavity 104 for storing modular electronic equipment 106 (e.g., as previously described) and a precast pier 160 configured to support the pipe 102 above a support surface (e.g., connected to the pipe 102 and configured to support the pipe 102 when the pier is inserted into the ground). In embodiments of the disclosure, the precast pier 160 can be cast in a material such as concrete and may include structural supporting material cast within the concrete, such as rebar and so forth. In some embodiments, a precast pier 160 can be formed using concrete having a twenty-eight (28) day compressive strength of about five thousand pounds per square inch (5000 psi). Rebar can be cast within the precast pier 160 (e.g., with about a three inch (3") concrete cover). Lifting plate assemblies can be tightened against the concrete surface using hex nuts and hardened flat washers (e.g., where the nuts are snug tight).

Wiring extends into the pipe 102 for connecting to the modular electronic equipment 106. In embodiments of the disclosure, the precast pier 160 is configured to support the pipe 102 above a support surface (e.g., the ground), and the wiring can be routed through the precast pier 160 into the pipe 102. For example, the precast pier 160 can include conduit 162 extending through the pier for routing the wiring through the pier to the interior cavity 104 of the pipe 102. In embodiments of the disclosure, the conduit 162 can be routed through the precast pier 160 to exit the pier in a direction generally parallel with the support surface (e.g., the ground). As described herein, the precast pier 160 can be configured to mount the pipe 102 in a variety of ways. For example, the precast pier 160 can be configured to mount a radio and power pole with, for instance, a twenty inch (20") diameter bolt pattern.

In some embodiments, a radio and power pole 100 can be configured as a direct bury radio and power pole 100 (possibly including one or more vaults 164), where a direct bury pole is used to facilitate short term (e.g., one day) installations. For example, an auger 166 is used to form a hole 168 for receiving a direct bury pole, the direct bury pole is plumbed, the direct bury pole is set, and then the radio and power pole 100 is attached to complete the installation. In this manner, right of way friendly installation is provided, and the equipment can be fully installed and tested prior to installation (e.g., at a manufacturing facility). In some embodiments, the hole 168 used to receive a precast pier 160 can be about thirty six inches (36") in diameter. When installed, the top of the precast pier 160 can be held level (e.g., to about plus or minus one degree (1°)) during installation of grout. Then, a quick-setting grout 174 can be used for same day installation of the precast pier 160. The grout may be non-shrink, having a seven (7) day compressive strength of about five thousand pounds per square inch (5000 psi). Air voids within the grout space can be reduced or minimized by tamping with a rod during installation.

In some embodiments, the precast pier 160 may include a laterally extending pad structure 170 distal to the pipe 102 and a vertically extending intermediate structure 172 proximal to the pipe 102. For example, the pad structure 170 has a generally rectangular first horizontal cross-sectional area and the intermediate structure 172 has a generally circular second horizontal cross-sectional area less than the first horizontal cross-sectional area. In embodiments of the disclosure, the first horizontal cross-sectional area and the second horizontal cross-sectional area can be generally centered about the pipe 102. In some embodiments, the pad structure 170 and intermediate structure 172 may employ other shapes, including, but not necessarily limited to: an elliptical shape, a square shape, a rectangular shape, an irregular shape, an asymmetrical shape, and so forth.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A radio and power pole comprising:

a pipe defining a longitudinal interior cavity for storing modular electronic equipment, a first vent below a middle of the pipe for drawing air into the interior cavity, and a second vent above the middle of the pipe and spaced apart from the first vent for exhausting the air from the interior cavity, the interior cavity providing a path for air drawn into the interior cavity at the first vent to be exhausted from the interior cavity at the second vent through a convection process;

a mounting channel extending longitudinally proximate to an interior surface of the interior cavity of the pipe, the mounting channel configured as a conduit for receiving electrical wiring;

a unitary structural spine extending longitudinally through the interior cavity of the pipe, the unitary structural spine extending at least substantially the entire length of the radio and power pole; and a plurality of ribs spaced apart from one another proximate to the interior surface of the interior cavity of the pipe, at least one of the plurality of ribs configured to hold an antenna, the mounting channel and the unitary structural spine connected together by the plurality of ribs.

2. The radio and power pole as recited in claim 1, wherein the mounting channel is configured to support radio equipment.

3. The radio and power pole as recited in claim 1, further comprising a door for accessing the interior cavity of the pipe.

4. The radio and power pole as recited in claim 1, wherein at least one of the plurality of ribs is configured to connect to a racking bracket.

5. The radio and power pole as recited in claim 1, further comprising a vent trap.

6. A radio and power pole comprising:

a pipe defining a longitudinal interior cavity for storing modular electronic equipment, a first vent below a middle of the pipe for drawing air into the interior cavity, and a second vent above the middle of the pipe and spaced apart from the first vent for exhausting the air from the interior cavity, the interior cavity providing a path for air drawn into the interior cavity at the first vent to be exhausted from the interior cavity at the second vent through a convection process;

a mounting channel extending longitudinally proximate to an interior surface of the interior cavity of the pipe;

a unitary structural spine extending longitudinally through the interior cavity of the pipe, the unitary structural spine extending at least substantially the entire length of the radio and power pole; and a plurality of ribs spaced apart from one another proximate to the interior surface of the interior cavity of the pipe, the mounting channel and the unitary structural spine connected together by the plurality of ribs.

7. The radio and power pole as recited in claim 6, wherein the mounting channel is configured as a conduit for receiving electrical wiring.

8. The radio and power pole as recited in claim 6, wherein the mounting channel is configured to support radio equipment.

9. The radio and power pole as recited in claim 6, further comprising a door for accessing the interior cavity of the pipe.

10. The radio and power pole as recited in claim 6, wherein at least one of the plurality of ribs is configured to hold an antenna.

11. The radio and power pole as recited in claim 6, wherein at least one of the plurality of ribs is configured to connect to a racking bracket.

12. The radio and power pole as recited in claim 6, further comprising a vent trap.

13. A radio and power pole comprising:

a pipe defining a longitudinal interior cavity for storing modular electronic equipment;

a mounting channel extending longitudinally proximate to an interior surface of the interior cavity of the pipe;

a structural spine extending longitudinally through the interior cavity of the pipe; and a plurality of ribs spaced apart from one another proximate to the interior surface of the interior cavity of the pipe, the mounting channel and the structural spine connected together by the plurality of ribs, wherein the pipe defines a first vent below a middle of the pipe for drawing air into the interior cavity, and a second vent above the middle of the pipe and spaced apart from the first vent for exhausting the air from the interior cavity, the interior cavity providing a path for air drawn into the interior cavity at the first vent to be exhausted from the interior cavity at the second vent through a convection process.

14. The radio and power pole as recited in claim 13, wherein the mounting channel is configured as a conduit for receiving electrical wiring.

15. The radio and power pole as recited in claim 13, wherein the mounting channel is configured to support radio equipment.

16. The radio and power pole as recited in claim 13, further comprising a door for accessing the interior cavity of the pipe.

17. The radio and power pole as recited in claim 13, wherein at least one of the plurality of ribs is configured to hold an antenna.

18. The radio and power pole as recited in claim 13, wherein at least one of the plurality of ribs is configured to connect to a racking bracket.

19. The radio and power pole as recited in claim 13, further comprising a vent trap.

* * * * *